United States Patent [19]

Kahn

[11] 4,032,100

[45] June 28, 1977

[54] INSTANT SCAFFOLD AND PAINT CAN HOLDER

[76] Inventor: William J. Kahn, 320 E. 30 St., Paterson, N.J. 07504

[22] Filed: Mar. 11, 1976

[21] Appl. No.: 666,009

[52] U.S. Cl. ..... 248/211; 248/227; 248/226.4

[51] Int. Cl.² ..... E06C 7/14

[58] Field of Search ..... 248/210, 211, 339, 340, 248/341, 216, 217, 218, 226 R, 226 A, 227, 228, 246

[56] References Cited

UNITED STATES PATENTS

| | | | |
|---|---|---|---|
| 141,498 | 8/1873 | Edmonston | 248/246 |
| 148,875 | 3/1874 | Crockett | 248/246 |
| 968,417 | 8/1910 | Reeder | 248/246 |
| 985,062 | 2/1911 | Rendleman | 248/227 |
| 1,256,909 | 2/1918 | Kroshaug | 248/210 |
| 2,814,455 | 11/1957 | Rainey | 248/226 A |
| 3,353,778 | 11/1967 | Sylvain et al. | 248/211 |

*Primary Examiner*—Robert A. Hafer
*Attorney, Agent, or Firm*—Fred A. Keire; Pasquale A. Razzano

[57] ABSTRACT

A support device for use in forming scaffolding or for supporting a paint bucket on the rail of a ladder or the like, consists of a pair of opposed bracket members having substantially identical configurations adapted to receive the ladder support rail or post therebetween. These bracket members each include flange elements extending outwardly therefrom and located in parallel relation to each other in the operative position of the device on the support rail. A generally L-shaped support bar having first and second angularly related legs is pivotally secured to the bracket members between their respective flanges adjacent the junction between the angularly related legs by a pivot pin which extends through the flange elements and support bar, with the flange elements being generally slidable along the pivot pin. A spring member is operatively engaged between the flange elements to bias these elements apart to extreme positions along the pivot pin. In this manner the bracket elements can be urged apart, as by manually squeezing the flange elements towards each other against the bias of the spring means, in order to permit adjustment of the position of the support device on the post. In the operative position of the device one of the legs of the support bar engages the support rail below the bracket elements, and is urged into engagement with that rail by a weight, for example a bucket of paint or a scaffold beam on the other of the legs, so that the bracket elements and support bar cooperate to hold the support device in a fixed position along the support rail.

12 Claims, 8 Drawing Figures

FIG. 1
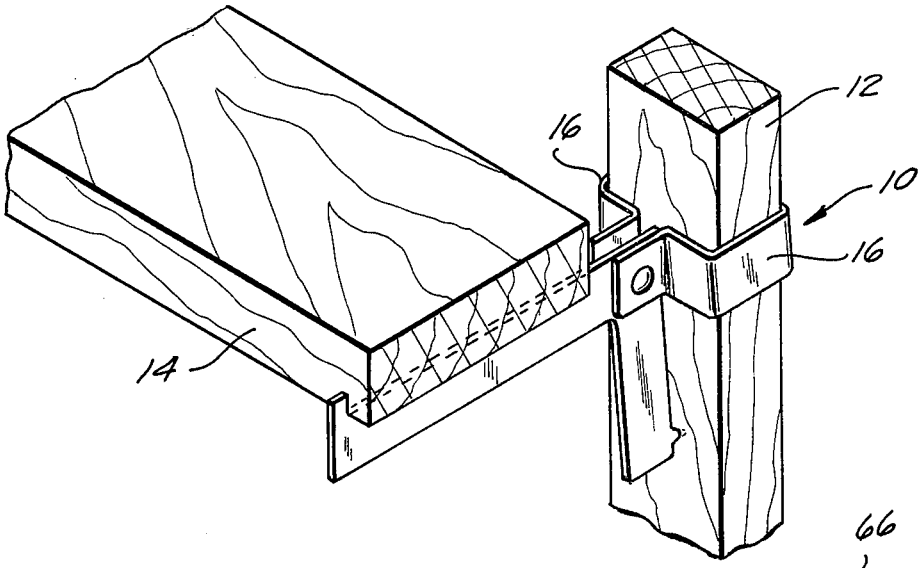
FIG. 6
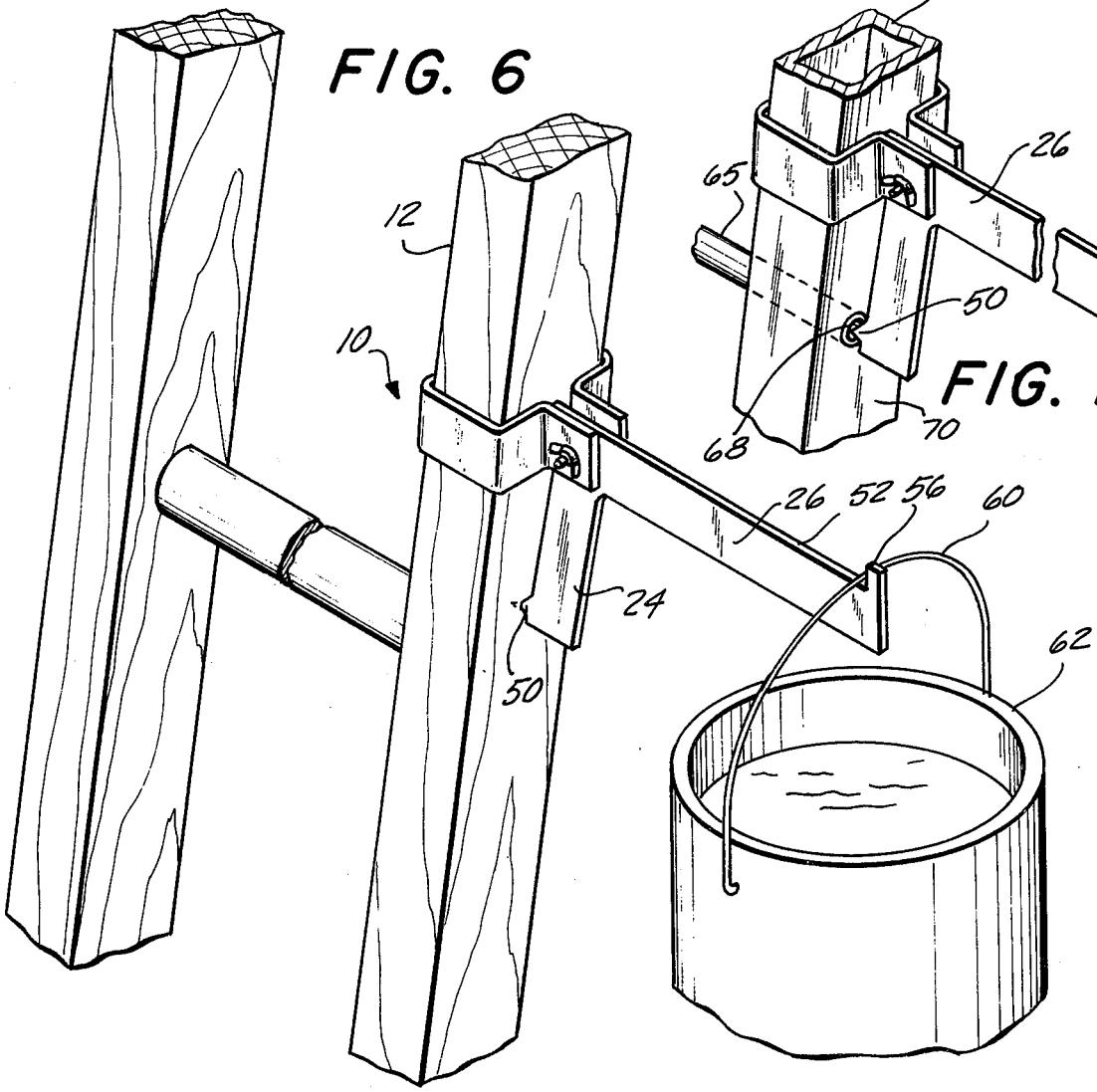
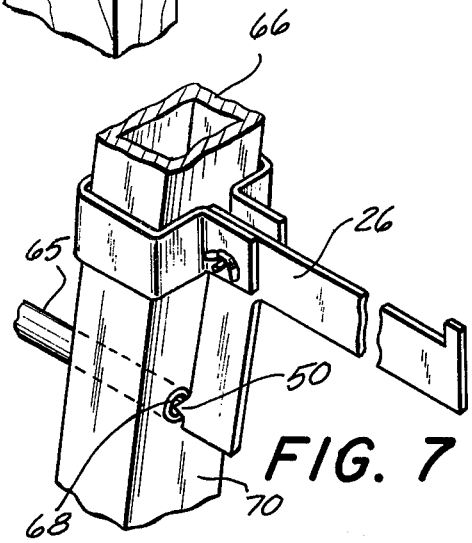
FIG. 7

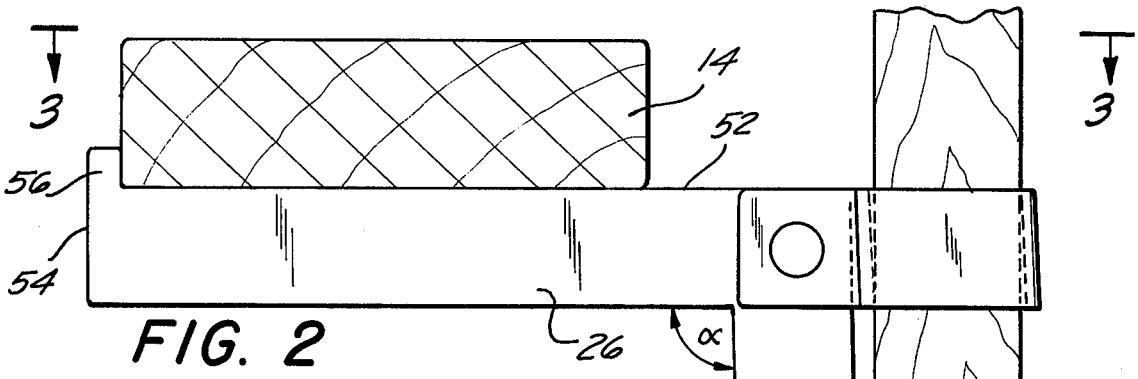
FIG. 2
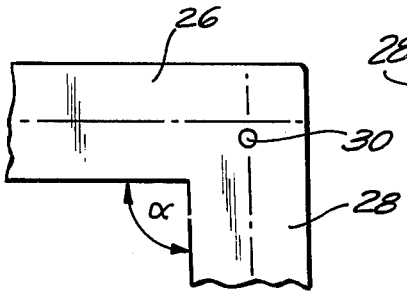
FIG. 2A
FIG. 3
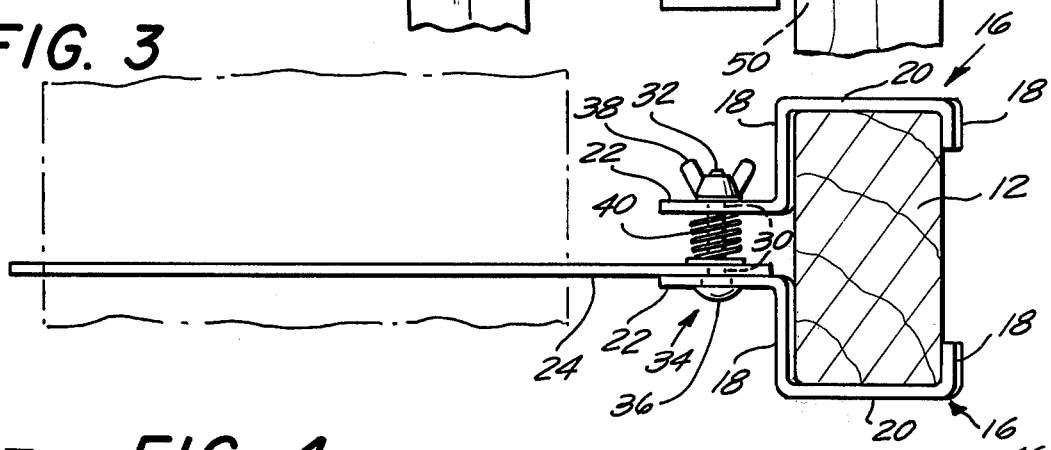
FIG. 4
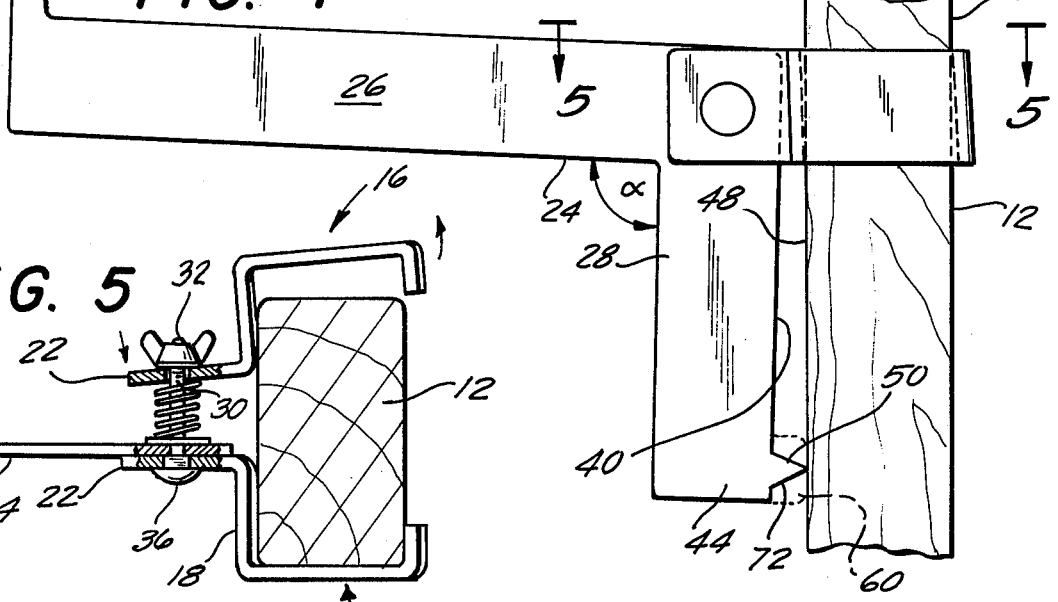
FIG. 5
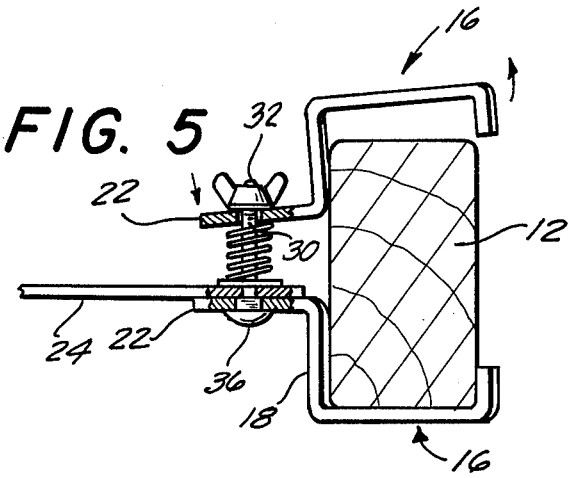

INSTANT SCAFFOLD AND PAINT CAN HOLDER

The present invention relates to a support for use in forming scaffolds or supporting a bucket of paint or the like on a ladder, and more particularly to an adjustable support element adapted to perform these functions.

It is often necessary for a workman to form a scaffold in order to facilitate the performance of his work above the ground. For example house painters often form scaffolds using ladders and scaffold beams or lengths of lumber extending between the ladders in order to facilitate painting the side of a house or the ceiling of a room. Similarly when on a ladder the painter must have some support element for holding the bucket of paint while he holds the ladder with one hand and paints with the other. In many cases, it is uneconomical for the workman to have an elaborate scaffolding arrangement, and therefore it is desirable for the workmam to have an inexpensive but safe device to enable him to form a scaffold simply with a ladder or vertical support post and a beam or piece of lumber. In either case, whether forming a scaffold with the support device or when using a device for supporting a bucket of paint, it is highly desirable that the support device be of light weight and readily adjustable to permit the workman to change its position as the work progresses.

A number of previously proposed bracket arrangements have been provided which will permit a workman to form a scaffold or support a bucket of paint on a ladder or vertical support beam. For example, U.S. Pat. No. 1,303,148 to Areson discloses a scaffolding bracket for use in ship building, which bracket is adapted to be secured to the ribs of a ship during its construction. Another bracket arrangement, for supporting objects on a vertical molding is disclosed in U.S. Pat. No. 1,276,677 to Mittleburg. Paint bucket support brackets of various constructions, adapted to be secured to the side rail of a ladder are also disclosed in U.S. Pat. Nos. 3,156,443 to Lupinacci; 3,353,778 to Sylvain and 3,396,929 to Brown. The one piece bracket elements shown in the Mittleburg and Lupinacci patents are relatively lightweight and would not appear to be suitable for use in forming scaffolding. They also would be difficult to manufacture because of the complex bends required, and would be difficult to readily and rapidly adjust along their cooperating vertical support post. The Areson scaffolding bracket on the other hand appears to be, in effect, a clamping arrangement which is firmly secured to the support rib and must be disassembled in order to allow vertical adjustment. The Brown and Sylvain patents also appear to require that the bracket assemblies disclosed therein be disassembled in order to adjust their position along the ladder on which they are used. This of course is a time-consuming operation which limits the value of such devices.

It is an object of the present invention to provide a scaffolding support device which is suitable for use in forming a scaffold or supporting a weight such as a bucket of paint or the like that is readily adjustable along the support rail on which it is mounted.

Another object of the present invention is to provide a scaffolding bracket or support for buckets which is relatively inexpensive to manufacture and yet durable in construction.

A further object of the present invention is to provide a support device for forming scaffolding or supporting a bucket or the like which is readily adjustable along the length of the support rail or post on which it is mounted.

In accordance with an aspect of the present invention the support device consists of a pair of opposed bracket members of substantially identical generally C-shaped configuration which, in the normal operative position thereof are located with their open sides facing each other in order to receive therebetween the generally vertically extending support rail or side post of a ladder or the like. These bracket members each include a flange element extending outwardly from one end thereof in spaced parallel relation to each other in the operative position of the support device on the ladder rail. A generally L-shaped support bar having first and second angularly related legs is positioned with the juncture between the legs located between the flange elements of the brackets. Those flange elements, and the support bar at the juncture between its legs, have apertures formed therein which are in general alignment with each other in the assembled device. A threaded bolt having a head at one end thereof extends through these apertures to pivotally interconnect the bracket members and the support bar. A nut is placed on the end of the bolt adjacent one of the flange elements, exteriorally thereof with respect to the support bar, so that the bracket members are slidable between the nut and bolt head along the bolt. A resilient coil spring surrounds the bolt and has its opposed ends respectively engaged with one of the flange elements of one of the bracket members and the support bar so that the support bar is held adjacent the other of the flange elements and the flange elements are biased away from each other to respectively engage the nut and bolt head.

In the operative position of the device, the side rail or post of the ladder is captured between the generally C-shaped bracket members with the first leg portion of the support bar extending generally horizontally away from the bracket elements and the ladder while the second leg portion thereof extends generally vertically into engagement with the support rail thereby to cooperate with the bracket elements to hold the support device in a selected position on the rail. When a weight such as a scaffolding beam or a bucket of paint is placed on the horizontal leg of the support bar, the second vertical leg of the support bar is urged into tight engagement with the ladder rail in order to maintain the support device in the selected position. When it is desired to move the support device to another position, in order to raise the scaffolding or bucket, the weight is removed from the support device and the flange elements of the brackets are simply manually squeezed towards each other against the bias of the spring in order to spread the bracket elements and permit ready sliding movement thereof along the support rail. In this manner, no disassembly of the bracket elements is required, and as soon as the pressure on the flange elements is relieved, the bracket elements will return to their original position and cooperate with the second leg of the support bar in order to hold the support device in position on the ladder rail.

The above, and other objects, features and advantages of this invention will be apparent in the following detailed description of an illustrative embodiment thereof, which is to be read in connection with the accompanying drawings, wherein:

FIG. 1 is a perspective view of a support device constructed in accordance with the present invention;

FIG. 2 is a side view of the support device illustrated in FIG. 1;

FIG. 2A is a partial side view of the L-shaped support bar used in the device of FIG. 2;

FIG. 3 is a plan view, taken along lines 3—3 of FIG. 2;

FIG. 4 is a side view, similar to FIG. 2, showing the configuration of the device before a weight is placed on the support bar;

FIG. 5 is a plan view, similar to FIG. 3, showing the opening of the bracket elements upon the application of a squeezing force through the flange elements thereof;

FIG. 6 is a perspective view showing the use of the device to support a paint bucket; and FIG. 7 is a persepective view, similar to FIG. 6, showing the use of the device with an aluminum ladder.

Referring now to the drawing in detail, and initially to FIGS. 1 and 3 thereof, a support device 10, constructed in accordance with the present invention, is shown mounted on a vertically extending post 12, which may comprise for example a two by four or four by four or the side rail of an extension ladder or the like. As illustrated in FIG. 1, the support device 10 is engaged with a plank or piece of lumber 14 suitable for use in forming a scaffold. To form a scaffold, a similar vertically extending support post 12 and an additional support device would be provided at the opposite end of the plank 14 in order to support the opposed ends of the plank.

Support device 10 includes a pair of bracket elements 16 which are of generally C-shaped configuration including leg portions 18 and bight portions 20 extending therebetween. In the illustrative embodiment of the invention these legs and bight portions are angularly related to each other, preferably at right angles, so as to conform to the angular surfaces of the support post 12. However it is contemplated that the bracket elements may have a generally semicircular configuration in order to cooperate with a round support post.

These bracket elements have flange members 22 integrally formed therewith and extending outwardly therefrom, as seen in FIG. 3. When the bracket elements are supported on the support post 12, the flange elements 22 extend outwardly from the support post and brackets in generally parallel relation.

A support bar 24 having a generally L-shaped configuration (see FIG. 2) is pivotally secured to the bracket members between the flange elements 22. This support bar has a first generally horizontally extending leg 26 and a second generally vertically extending leg 28 integrally formed therewith. The flange elements and support bar have apertures 30 formed therein located in general alignment with each other, to receive the stem 32 of a bolt 34. The bolt head 36 is located adjacent one of the flange elements 22, on the side thereof opposite the support bar 24 while the stem 32 is threadably engaged with a wing nut 38, located adjacent the opposite flange 22. In this manner, the flange elements 22 and the support bar are slidable along the stem 32 of the bolt between the head 36 and nut 38. By adjusting the position of nut 38 on bolt 32, the spacing between the flange elements and thus the bracket members 16 can be varied.

As seen in FIG. 2A the aperture 30 in support bar 26 is slightly offset from the intersection of the longitudinal axes 26*a*, 26*b* of the support bar legs. By locating the aperture below this intersection, as shown, the support bar has an increased tendency to pivot in a counterclockwise direction (as viewed in FIG. 2) under its own weight, thereby to engage the end of the vertical legs of the support bar against the post 12.

A coil spring 40 surrounds the stem 32 of bolt 34, between the flange elements 22, and preferably has one end engaged with one of the flange elements and the other end engaged with the support bar 24 adjacent the aperture 30 at the juncture between legs 24, 26. This spring element serves to bias the flange members apart, into the position shown in FIG. 3, thereby to maintain stability of the bracket elements with respect to each other. However, the spring 40 allows the flange elements 22 to be urged towards each other, as for example by manually squeezing the flange elements towards each other so that the bracket elements can be spread apart, as illustrated in FIG. 5. This will permit the support device to be mounted on the rail 12 without disassembly, and also permits the device to be moved along the support rail without the need to disassemble the bracket elements or adjust the bolt end nut arrangement.

The spring 40, while holding the brackets apart also accommodates play in the bolt and nut arrangements and eliminates any need for precise positioning of the bolt. Moreover, the provision of C-shaped brackets and their closely spaced flanges permits bolt 34 to be quite short with the result that the bolt will be stronger and resist bending under stress to a greater extent than a bolt of like diameter used in a device such as shown in U.S. Pat. No. 3,353,778.

In operation, the bracket elements 16 are assembled with support bar 24, as illustrated in FIG. 5, and the brackets are spread apart by squeezing the flange elements 22 towards each other so that the bracket elements can be placed around the support post. When the flange elements 22 are released, the bracket elements are positioned as shown in FIG. 3 in closely surrounding relation about the support post or rail 12. In that position the vertical leg 28 of the support bar 24 will rest against the side surface 48 of the rail 12 with the leg 26 extending generally horizontally away from the rail. By this arrangement, the weight of the support device, and particularly the weight of the support bar is sufficient to maintain the support device in the selected position along the rail 12 as the bottom end portion 44 of leg 28 engages the side surface 48 of the rail and the legs 18 (the flanges shown at the right in FIG. 3) engage against the opposite side surface 46 of that rail. As seen in FIGS. 2 and 4, the bracket elements, under the influence of the weight of the support bar, cant slightly on post 12 so that the top portion of the legs 18 at the rear of the post and the bottom portion of the legs 18 at the front of the post engage the post and prevent movement of the device.

In the preferred embodiment of the invention the inner edge 48 of leg 28 includes a sharply pointed tooth element 50 which is adapted to bite into the post 12, particularly where the post is wood, to firmly secure the device in position when a weight is placed on the leg 26, thereby to prevent the support device from sliding downwardly on the rail.

After the support device is placed on rail 12 in the position illustrated in FIG. 4, the workman, in forming a scaffold, will place the scaffold plank or beam 14 on the horizontally extending leg 26 and either stand on the beam or apply a weight thereto in order to pivot the support bar 24 in a counterclockwise direction, as illustrated in FIG. 4. This will urge the leg 28 towards the rail 12 and cause the tooth 50 to penetrate into the side rail. In this connection it is noted that the angle alpha between the legs 26, 28 is preferably greater than 90° (on the order of 95° to 100°) so that when the tooth 50 penetrates the wooden rail 12, the top surface 52 of the leg 26 will extend substantially horizontally so that the plank 14 is horizontal and safer for the workman to stand on. In addition, the free end 54 of the leg 26 is provided with an upstanding stop element or hook 56, which will prevent the plank 14 from sliding outwardly on the leg 26.

In the event that the rail 12 is not formed of wood or other penetrable material, or if it is desired not to damage the side rail, a rubber stopper element 56 can be provided which is adapted to be placed over the tooth 50, so that only a frictional engagement is maintained between the leg 28 and the rail 12. This frictional engagement will be sufficient to support the scaffolding beam with workman thereon, particularly since the greater the weight which is placed on the leg 26, the greater will be the frictional force produced between the stopper 60 and the surface 48 of rail 12 resisting downward movement of the bracket. In any event, the engagement of the rail on opposite sides by the legs 18 of the canted bracket elements and by the bottom of the leg 28, will provide a sufficient grip between the support device and the rail to prevent sliding movement along the rail.

When the workman desires to move the scaffold to another level, he simply removes the plank 14 from the leg 26, squeezes the flange elements 22 towards each other, as illustrated in FIG. 5, (he would also pivot the support bar manually in a clockwise direction to disengage the tooth 50 from the rail 12 if the tooth had penetrated the rail) and then slides the support device along the rail to the next desired position. This is easily done without disassembling the support device or adjusting the bolt and nut combination securing the bracket members together.

As mentioned, the support device of the invention is also suitable for use as a bucket holder along the side rail of the ladder. As illustrated in FIG. 6, the support device 10 of the invention can be placed on the side rail 12 of a conventional runged ladder in the same manner as previously described with respect to FIGS. 1–5, and the bail 60 of a paint bucket 62 can be placed over the edge 52 of the horizontal leg 26 of the device. The stop member 56 on leg 26 forms a convenient hook preventing the bucket from falling off of the support device. Again, the weight of the bucket will urge the tooth 50 on leg 24 against and into the wooden side rail, to form a firm but releasable gripping engagement holding the support device on the ladder.

In FIG. 7, the support device 10 is illustrated in use on an aluminum extension ladder which, in accordance with conventionally available ladders of this type, has hollow rungs 65 that extend through the hollow side rails 66 of the ladder to form openings 68 in the side face 70 thereof. The support bracket can be placed anywhere along the side rail of the ladder with the tooth 50 engaged with face 70, and the frictional engagement formed therebetween under the influence of the weight placed on the leg 26 will be sufficient to hold the support bracket in place. However, as an additional safety feature, the support device can be placed in a position such that the tooth 50 will penetrate into the hole 68, and rest on the bottom edge of that aperture in the rung 65 so that it vertically supports the tooth 50. In this embodiment, it may be desirable that the lower surface 72 of the tooth 50 be formed so as to extend generally parallel to the leg 26, thereby giving the tooth 50 a wedge shape rather than a triangular shape. This will provide a more positive vertical support for the tooth.

Accordingly, it will be appreciated that a relatively simply constructed durable support device is provided which can be easily secured to a vertical support post to a side rail of a ladder, in order to form a scaffold device or bucket holder. The device, being formed perferably of relatively thick steel or iron, has substantial strength and will support substantial weights. The bracket elements can be formed in a variety of dimensions and shapes, to accommodate different sized or types of support rails. By making the support bar 24 in a generally L-shaped configuration with a vertical leg 28 having substantial length (for example five or six inches), a substantial moment force will be produced when a weight is placed on the leg 26, against the tooth 50, in order to resist and prevent movement of the support bracket along the rail. On the other hand, the support device is readily removed from the support rail and is readily adjusted along the length of the rail, without any need for disassembly or adjustment.

Although an illustrative embodiment of the present invention has been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A support device comprising a pair of opposed bracket members of substantially identical configuration adapted to receive a support post element therebetween, said bracket members each including a flange element extending outwardly therefrom and located in parallel relation to each other; a one piece generally L-shaped support bar having first and second angularly related legs; and means for pivotally securing said bar to said bracket members between said flange elements adjacent the juncture between said angularly related legs; said securing means including a pivot pin comprising a threaded bolt extending through said flange elements and said support bar, and a coil spring surrounding said bolt and having opposite ends respectively engaged between one of said flange elements and said support bar for biasing said flange elements apart and for holding said support bar adjacent the other of said flange elements whereby said bracket elements may be urged apart against the bias of said spring to permit adjustment of the position of the support device on said post; said bolt including a head portion located adjacent one of said flange elements on the side thereof opposite the support bar; and a nut threadably engaged with said bolt adjacent the other of said flange elements for selectively moving said flange elements towards each other against the bias of said spring.

2. A support device as defined in claim 1 wherein the angle between the angularly related legs of said support bar is greater than 90° .

3. A support device as defined in claim 1 wherein, in the operative supporting position of said device said first leg extends generally horizontally outwardly of said bracket elements and said second leg extends generally vertically.

4. A support device as defined in claim 3 wherein said first leg has a free end and an upstanding stop member formed thereon for preventing outward movement away from said support post of a scaffold beam supported on said first leg.

5. A support device as defined in claim 3 wherein said second leg has an inner edge which faces the support post in the operative position of the support device for engaging the post under the influence of the weight supported on said first leg.

6. A support device as defined in claim 5 wherein said inner edge of said second leg includes a pointed projection extending outwardly therefrom for engaging said post.

7. A support device comprising a pair of opposed bracket members of substantailly identical generally C-shaped configuration, normally operatively positioned with their open side facing each other to receive a support rail element therebetween, said bracket members each including a flange element extending outwardly from one end thereof in spaced parallel relation in the operative position of the support device on said rail; a one piece generally L-shaped support bar having first and second angularly related leg portions positioned with the juncture between said leg portions located between said flange elements; said flange elements and support bar, adjacent the juncture between its leg portion, having apertures formed therein which are in general alignment with each other in the operative position of the device; a threaded bolt, having a head at one end thereof, extending through said apertures to pivotally interconnect said bracket members and support bar, a nut on the end of said bolt adjacent one of said flange elements and located exteriorly thereof with respect to said support bar, whereby said bracket members are slidable between the nut and bolt head along said bolt; and a resilient coil spring surrounding said bolt and having opposed ends respectively engaged with the flange element of one of said bracket members and said support bar for holding said support bar adjacent the other of said flange elements and for biasing said flange elements away from each other to respectively engage said nut and bolt head, said bracket members thereby being adapted to be urged apart against the bias of said spring to permit adjustment of the position of the support device on said rail; said first leg portion of said support bar extending generally horizontally away from said bracket elements in the operative position of the device and said second leg portion extending generally vertically in engagement with said support rail, thereby to cooperate with said bracket elements to hold the device in a selected position on the rail.

8. A support device as defined in claim 7 wherein the angle between the angularly related legs of said support bar is greater than 90°.

9. A support device as defined in claim 8 wherein said first leg has a free end and an upstanding stop member formed thereon for preventing outward movement away from said support rail of a scaffold beam supported on said first leg.

10. A support device as defined in claim 9 wherein said second leg has an inner edge which faces the support rail in the operative position of the support device for engaging the rail under the influence of the weight supported on said first leg.

11. A support device as defined in claim 10 wherein said generally C-shaped bracket elements each have angularly related leg and bight portions adapted to engage and substantially surround corresponding surface portions of the support rail.

12. A support device as defined in claim 10 wherein said inner edge of said second leg includes a pointed projection extending outwardly therefrom for engaging said post.

* * * * *